United States Patent [19]

Grossberg

[11] 4,394,250

[45] Jul. 19, 1983

[54] DELAYED COKING PROCESS

[75] Inventor: Arnold L. Grossberg, Berkeley, Calif.

[73] Assignee: Chevron Research Company, San Francisco, Calif.

[21] Appl. No.: 341,338

[22] Filed: Jan. 21, 1982

[51] Int. Cl.[3] ..... C10G 47/26

[52] U.S. Cl. ..... 208/108; 208/50; 208/131; 208/111

[58] Field of Search ..... 208/108, 111, 131, 132, 208/50

[56] References Cited

U.S. PATENT DOCUMENTS

| | | | |
|---|---|---|---|
| 2,727,853 | 12/1955 | Hennig | 208/53 |
| 2,844,520 | 7/1958 | Viland | 208/114 |
| 2,871,182 | 1/1959 | Weekman | 208/50 |
| 2,885,350 | 5/1959 | Brown et al. | 208/127 |
| 2,888,395 | 5/1959 | Henny | 208/111 |
| 3,131,142 | 4/1964 | Mills | 208/108 |
| 3,193,486 | 7/1965 | Payne | 208/50 |
| 3,475,323 | 10/1969 | Stuckey et al. | 208/97 |
| 3,663,429 | 5/1972 | Vallino | 208/108 |
| 3,891,538 | 6/1975 | Walkey | 208/50 |
| 3,923,635 | 12/1975 | Schulman et al. | 208/50 |
| 3,956,101 | 5/1976 | Hara et al. | 208/50 |
| 4,169,041 | 9/1979 | Schuette | 208/108 |
| 4,178,227 | 12/1979 | Metrailer et al. | 208/50 |
| 4,204,943 | 5/1980 | Metrailer et al. | 208/50 |
| 4,324,645 | 4/1982 | Angevine et al. | 208/50 |
| 4,325,810 | 4/1982 | Alford et al. | 208/112 |
| 4,358,366 | 11/1982 | Alford et al. | 208/112 |

*Primary Examiner*—Delbert E. Gantz
*Assistant Examiner*—G. E. Schmitkons
*Attorney, Agent, or Firm*—Burns, Doane, Swecker & Mathis

[57] ABSTRACT

A catalytic delayed coking process is disclosed that gives increased distillate yield and reduced coke make. The process involves adding small amounts of cracking catalyst and hydrogen to the hydrocarbon feedstock before it is charged to the coking drum. The catalyst settles out in the coke and does not affect the utility of the coke.

4 Claims, 1 Drawing Figure

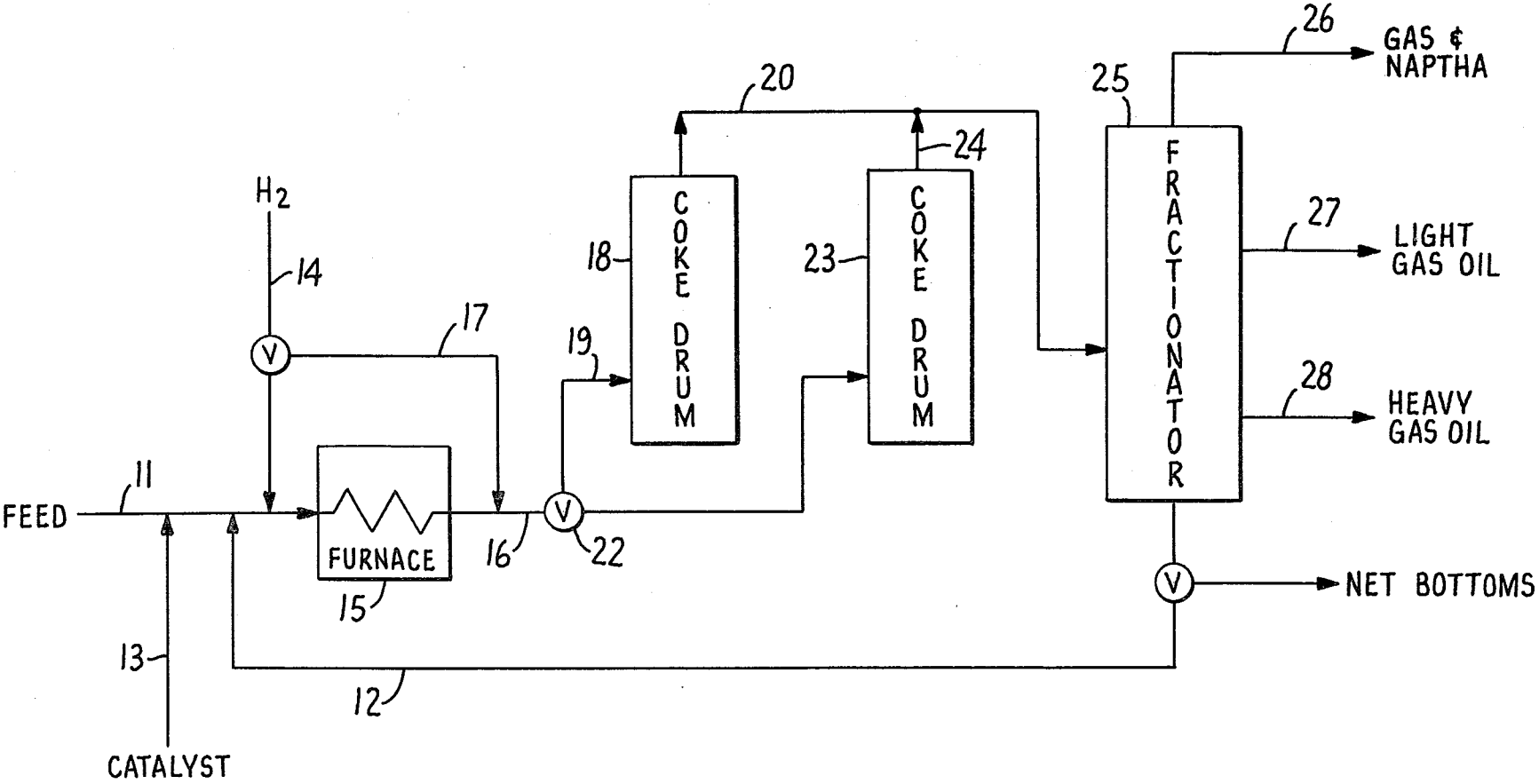
GAS & NAPTHA
LIGHT GAS OIL
HEAVY GAS OIL
NET BOTTOMS
FRACTIONATOR
COKE DRUM
COKE DRUM
FURNACE
$H_2$
FEED
CATALYST
11
12
13
14
15
16
17
18
19
20
22
23
24
25
26
27
28

DELAYED COKING PROCESS

BACKGROUND OF THE INVENTION

1. Field of the Invention

This invention relates to a delayed coking process in which small amounts of cracking catalyst and hydrogen are added to the coker feed to improve the distillate yield and decrease the coke make.

2. Description of the Prior Art

Delayed coking is a well-known oil refining process that is used to convert heavy hydrocarbon feedstocks into lighter hydrocarbon products and coke. In this process the heavy hydrocarbon feed is heated rapidly to cracking temperatures and fed into a coke drum. The heated feed soaks in the drum in its contained heat which is sufficient to convert it into cracked vapors and coke. The cracked vapors are taken overhead and fractionated, with the fractionator bottoms usually being recycled to feed. The coke accumulates in the drum until the drum is filled with coke, at which time the heated feed is diverted to another coke drum while the coke is removed from the filled drum.

Numerous coking processes are described in the patent literature in which the coker feed is first hydroprocessed to remove metals or sulfur before being fed to the coker furnace. See, for instance, U.S. Pat. Nos. 2,871,182, 2,963,416, 3,617,487, 3,817,853, and 3,684,688.

It is also known to use the residuums from catalytic cracking processes as a feed to delayed coking processes. U.S. Pat. No. 3,326,796 teaches a process for making electrode grade coke by subjecting such residuum to delayed coking.

U.S. Pat. No. 3,619,413 describes a delayed coking process in which small amounts of hydrogen halide or hydrocarbyl halides are added to the heated feed to the coke drums. The addition of such halides is alleged to make the volatile content of the coke more uniform without affecting the distillate yield adversely.

U.S. Pat. No. 4,169,041 describes a fluid hydrocoking process in which metallic hydrogenation catalysts, particularly molybdenum, chromium, and vanadium are added to the fluid coking feedstock. The addition of such metals is reported to increase distillate yield and reduce coke yield. U.S. Pat. Nos. 2,888,393 and 2,888,395 also teach the use of hydrogen and hydrogen plus catalyst, respectively, in fluid coking.

SUMMARY OF THE INVENTION

The invention is an improvement in a delayed coking process in which a hydrocarbon feedstock is heated to cracking temperatures and thereafter introduced into a coking drum under delayed coking conditions. The improvement comprises adding a cracking catalyst and hydrogen to the feedstock in amounts sufficient to cause an increase in the distillate yield from the process.

BRIEF DESCRIPTION OF THE DRAWING

The drawing is a schematic flow diagram of a preferred embodiment of the invention.

DETAILED DESCRIPTION OF THE INVENTION

Suitable hydrocarbon feedstocks for delayed coking are described in the art. The feedstock may be derived from petroleum, shale, coal, tar and/or other hydrocarbon sources. It is typically a heavy low-grade oil such as heavy virgin crude, reduced crude, topped crude, residuums from refining processes such as thermal or catalytic cracking processes or blends of such stocks. These feedstocks may be hydrotreated, if desired, before being fed to the coking process to remove sulfur, metals, and other contaminants.

Referring to the drawing, the feedstock is introduced into the coking process via line 11 together with recycle oil from line 12, cracking catalyst from line 13, and, optionally, hydrogen from line 14. The catalyst will normally be added to the fuel in the form of an oil slurry or dispersion in amounts in the range of about 0.1% to about 3% by weight. The preferred percent catalyst will be varied depending upon the coke-forming propensity of the feed, based on combined feed and recycle oil, and the desired quality of the resultant coke. The catalyst is one that promotes cracking or hydrocracking. The catalyst may be fresh or spent. Spent catalysts are those that have undergone prior cracking or hydroprocessing service. Examples of cracking catalysts that may be used are silica, alumina, bauxite, silica-alumina, silica-magnesia, silica-alumina-zirconia, zeolites, and acid treated natural clays. Hydrocracking catalysts typically comprise a composite of a cracking catalyst, such as those described above, and a hydrogenation catalyst such as a Group VI, Group VII, or Group VIII metal or oxides or sulfides thereof. Spent catalysts will also usually contain significant amounts of deposited metals such as Ni, V, and Fe from their prior service. Spent catalyst fines from a fluid catalytic cracking process is a preferred catalyst. The catalyst may be added to the combined feed-recycle oil after the latter is heated to avoid the possibility of significant coking occuring in the heating step of the process. Such coking may lead to plugging of the heating apparatus. The hydrogen may be added to the feed-recycle oil-catalyst mixture either before or after the mixture is heated. Alternatively, part of the hydrogen may be added before heating and part after heating. The total amount of hydrogen added will depend on the operating pressure of the coker and will usually be less than about 1000 SCF per barrel of combined feed-recycle oil, typically 50–500 SCF per barrel. The weight ratio of feed to recycle oil will typically be in the range of about 100:1 to about 0.5:1, preferably 50:1 to 1:1. Alternatively the process may be operated on a once-through basis with fresh feed only.

The mixture is heated in furnace 15 to temperatures normally in the range of about 850° F. to 1100° F., and preferably in the range of 900° F. to 975° F. A furnace that heats the mixture rapidly to such temperatures, such as a pipestill, is normally used. The mixture exits the furnace at substantially the above-indicated temperatures through line 16 and hydrogen, if any, is added to the furnace effluent from line 17. This mixture is introduced into the bottom of coke drum 18 via line 19 which connects into line 16. The mixture is charged to the coke drum at pressures usually ranging between about 20 to 200 psig. Higher pressures may be used to increase the reaction between the feed-recycle oil and the hydrogen in the mixture if desired. The coke drum is insulated and may also be heated, such as by introduction of heated inert gas into the drum, so as to maintain the drum's contents at a temperature in the range of about 800° F. to about 1200° F., more usually 750° F. to 950° F. Inside the drum the heavy hydrocarbon in the mixture cracks both thermally and under the influence of the catalyst, and reacts with the hydrogen to form cracked vapors and coke. Because of the presence of the catalyst and hydrogen in the mixture the vapor production is increased and the coke make is decreased markedly relative to a delayed coking process carried out under the same operating conditions but without adding catalyst and hydrogen.

The vapors are continuously removed overhead from the drum through line 20. The coke accumulates in the drum until it reaches a predetermined level at which time the feed to the drum is shut off and switched by valve 22 to a second coke drum 23. The operation of drum 23 is identical to that of drum 18. Its vapor withdrawal line 24 connects into line 20. This switching permits drum 18 to be taken out of service, opened, and the accumulated coke removed therefrom using conventional techniques.

An added advantage of the invention process is that it provides an efficient manner of disposing of catalyst fines, such as those from fluid catalytic cracking processes. In this regard, the catalyst component will settle out and be incorporated into the coke. Its presence in the coke will usually have no adverse effects on the utility of the coke as a fuel, in steel making, or other common uses for green or calcined coke.

The vapors that are taken overhead from the coke drum(s) are carried by line 20 to a fractionator 25. As indicated in the drawing the vapors will typically be fractionated into a gas and naphtha product stream 26, a light gas oil product stream 27, a heavy gas oil product stream 28, and a residual bottoms taken from the fractionator via line 12. The three product streams constitute the distillate yield from the process. The distillate yield from the catalytic delayed coking process of the invention is significantly better than the distillate yield from a conventional delayed coking process using the same hydrocarbon feed and operating conditions. Also, the quality of the distillate from the invention process is improved relative to the distillate from a comparable conventional process. That is, the invention distillate will typically contain a higher proportion of lighter products than the distillate from a comparable conventional delayed coking process.

As indicated previously the residuum from the fractionator is recycled at the desired ratio to the furnace via lines 12 and 11. Any excess net bottoms may be subjected to conventional residual refining techniques if desired.

Modifications of the above-described example and embodiments of this catalytic delayed coking process that are obvious to those of skill in the oil processing art are intended to be within the scope of the following claims.

I claim:

1. In a delayed coking process comprising heating a hydrocarbon feedstock to cracking temperatures and thereafter introducing the heated feedstock into a coking drum under delayed coking conditions wherein the heated feedstock soaks in the drum in its contained heat which is sufficient to convert the feedstock to cracked vapors and coke, the improvement comprising adding a cracking catalyst in an amount in the range of about 0.1 to about 3% by weight based on the hydrocarbon feedstock and hydrogen in an amount in the range of about 50 to about 500 SCF per barrel of the hydrocarbon feedstock to the feedstock thereby causing an increase in the distillate yield from the process.

2. The process of claim 1 wherein the catalyst is added to the feedstock before the feedstock is heated and the hydrogen is added to the feedstock after the feedstock is heated.

3. The process of claim 1 wherein the feedstock is heated to 850° F. to 1100° F. and the delayed coking conditions are 20 to 200 psig and 800° F. to 1200° F.

4. The process of claim 2 wherein the feedstock is heated to 850° F. to 1100° F., the delayed coking conditions are 20 to 200 psig and 800° F. to 1200° F., and the catalyst is fluid catalytic cracking fines.

* * * * *